United States Patent [19]

Metz et al.

[11] 4,369,060

[45] Jan. 18, 1983

[54] PROCESS OF REFINING OF A METAL BATH IN A CRUCIBLE WITH OXYGEN BLAST AT THE TOP AND CRUCIBLE USED

[75] Inventors: Paul Metz, Luxembourg; Francois Schleimer; Ferdinand Goedert, both of Esch; Lucien Lorang, Differdange; Romain Henrion, Esch, all of Luxembourg; Jean-Claude Grosjean, Semecourt, France; Guy Denier, Metz, France; Claude Bauler, Carry-le-Rouet, France

[73] Assignees: Arbed S.A., Luxembourg, Luxembourg; Irsid, Saint-Germain-en-Laye, France

[21] Appl. No.: 222,512

[22] Filed: Jan. 2, 1981

[30] Foreign Application Priority Data

Jan. 9, 1980 [LU] Luxembourg ..... 82060

[51] Int. Cl.[3] ..... C21C 5/48; C21C 5/42

[52] U.S. Cl. ..... 75/60; 75/59; 266/218; 266/243

[58] Field of Search ..... 75/52, 59, 60; 266/218, 266/243-244

[56] References Cited

U.S. PATENT DOCUMENTS

| | | | |
|---|---|---|---|
| 3,854,932 | 12/1974 | Bishop | 75/60 |
| 4,195,985 | 4/1980 | Brotzmann | 75/60 |
| 4,198,230 | 4/1980 | Brotzmann | 75/60 |
| 4,280,838 | 7/1981 | Marukowa | 75/52 |

*Primary Examiner*—P. D. Rosenberg

*Attorney, Agent, or Firm*—Michael J. Striker

[57] ABSTRACT

Process of refining of a metal bath in a crucible with oxygen blast at the top and crucible used.

The invention consists essentially of providing in the bottom (15) of the crucible agitating gas injectors (15) located at least in a peripheral circular ring situated in immediate proximity to the refractory side wall. The injectors are preferably concentrated opposite the journals. Secondary injectors are, also preferably, provided in the bottom zone, intermediate between the ring and the center of the crucible.

The invention makes it possible, in relation to the prior injection practice, to reduce the rate of dissolution of the agitating gas in the molten metal and then makes it possible to use a low-cost agitating gas, such as nitrogen, without risk of excessive nitridation of the bath.

10 Claims, 2 Drawing Figures

PROCESS OF REFINING OF A METAL BATH IN A CRUCIBLE WITH OXYGEN BLAST AT THE TOP AND CRUCIBLE USED

BACKGROUND OF THE INVENTION

This invention relates to the manufacture of metals and, notably, steel. It concerns, in particular, the pneumatic refining of a cast iron bath contained in a crucible with oxygen blown at the top.

It is known that a refining crucible with oxygen blown at the top is a metal vessel with a thick refractory lining. The vessel consists essentially of a cylindrical vertical part (called side wall), which is, on the one hand, closed at its lower end by a fixed circular bottom and, on the other, extended at its upper end by a truncated cone-shaped part forming the lip. A vertical nozzle enters through the latter for the blast of one or more refining oxygen jets in the direction of the surface of the metal bath contained in the crucible.

It is known that the metallurgical possibilities of the methods of refining cast iron by blowing oxygen at the top can be widened by injecting an agitating gas at the bottom of the crucible. That gas is usually chemically inert to impurities in the metal, like nitrogen, argon, etc., pure or mixed. But it is not out of the question to use a reagent gas, such as oxygen or $CO_2$, whether pure or mixed with an inert gas and which, in addition to its agitating function, participates in the refining proper, by combining its action with that of the oxygen blown at the top.

It is known that the beneficial effects that can be expected from same are, notably, an easier handling of the blast and an improvement of the iron yield and of the quality of the steel, as well as a reduction of the consumption of deoxidizers and ferroalloys. One can also benefit from an increase in the quantity of coolant additions (scrap or ore), thanks to an increase in the rate of secondary combustion $$\left(\frac{\%\ CO}{\%\ CO + \%\ CO_2}\right),$$

when, as described, for example, in Luxembourg Patent Application No. 81,207, the process is used jointly with the maintenance of a well distributed oxygen atmosphere on the surface of the bath.

SUMMARY OF THE INVENTION

One of the principal technological characteristics of the process is the incorporation in the bottom of the crucible of injectors making it possible to blow the agitating gas into the bath at any time during and/or after the blast of refining oxygen at the top. The injectors used, having to guarantee a selective passage of the agitating gas, in order to avoid infiltrations of molten metal in the opposite direction, can be tuyeres of small section (a few $mm^2$) or, preferably, air-permeable refractory elements. Elements of that type now exist, the lifetime of which is equal to that of the crucible and for which several patent applications have been filed by the inventors.

This flexibility in choice of the time, duration and intensity of the gas injection makes it possible, as quickly pointed out above, to improve considerably the performances of the crucibles with oxygen blown at the top, by combining their proper advantages with those of the standard processes with oxygen blast at the bottom.

This new method has just won industrial approval under the name of "LBE" Process (Nozzle-Agitation-Balance), evoking the balance it tends to create between the metal and the slag in the crucible.

The inventors have now just discovered that the LBE process makes it possible to widen considerably the possibilities of refining with oxygen at the top, not only thanks to the flexibility already mentioned in the choice of the time, duration and intensity of gas agitation, but also—and quite surprisingly—because of a wise choice of the geometric conditions to which such agitation must conform. Furthermore, that choice can be used very simply on the basis of considerations involving only the location of the injectors at the bottom of the crucible.

For that purpose, the object of the invention is a process of refining of a metal bath, particularly cast iron, in a crucible with oxygen blast at the top and according to which an agitating gas is blown at the bottom, a process characterized in that the agitating gas is blown, at least in part, on the periphery of the bottom of the crucible, in the immediate vicinity of the side wall of the latter.

The invention also concerns a particular crucible for use of the process, characterized in that it presents, incorporated in its refractory lining, injectors for blowing the agitating gas, located in the bottom of the crucible, along a circle situated in the immediate vicinity of the side wall of the latter.

Up to now it was customary to distribute the injectors in the bottom of the crucible according to a circular arrangement almost midway between the center of the bottom and the side wall. This arrangement represented a logical location for obtaining an optimal agitating effect, taking into account the oxygen jet or jet blown at the top, the points of impact of which lie in the central region of the surface of the bath.

The use of the invention, which, as will be understood, consists essentially of pushing the injecting gas blast zone back as far as possible toward the periphery of the bottom, has a remarkable result, by comparison with the usual method: stabilizing the nitridation of the bath at levels wholly acceptable for practically all the grades manufactured to date. The importance of this result will be better understood, after having indicated that, in previous practice, blowing with nitrogen led to variable residual levels of that element, often departing from the tolerances allowed and entailing either rejection of the charge or the always difficult and expensive subsequent corrective treatments, after the fashion of vacuum treatments.

The invention offers then, in particular, the advantage of being able to use, in any circumstance and throughout the refining operation, an agitating gas that is by nature soluble in the liquid metal under certain conditions, following the example of nitrogen, without risk of excessive dissolution. This possibility enables the cost of the operation to be reduced in appreciable proportions, since, as is known, among the gases for industrial and steel-making use, in particular, nitrogen is undoubtedly the most economical, notably, as a byproduct of the manufacture of oxygen from atmospheric air.

Furthermore, it is possible, according to one preferred variant of the invention, to combine this peripheral location with the traditional location, by geometrically dividing the possibilities of injection according to two concentric circles on the bottom of the crucible, one on the periphery and the other approximately midway between the center of the bottom and the side wall of the crucible.

It is thus possible to increase the total flow of agitating gas, while modulating it, notably, in order to reserve peripheral blowing for the most critical times when, in the course of refining, conditions are such that nitridation of the bath is to be feared (notably, at the end of the decarbonization period, when the bath reaches its maximum temperature and washing with CO is less effective).

It is then possible, with a pneumatic station feeding the two categories of injectors separately—in peripheral position and in mid-position respectively—, to attain optimum agitating conditions, while avoiding an excessive intake of nitrogen by the bath. That result can easily be accomplished by any appropriate means of measurement of the nitridation tendency of the bath.

In that connection, and according to one preferred embodiment of the invention, the parameters indicative of the nitridation tendency of the metal bath are determined in the course of refining at a sufficient rate, and one reacts, according to the response obtained, by effecting a change of geometric conditions of blowing of agitating gas, in the sense that this blowing is preferably carried out by the injectors situated on the periphery of the bottom of the crucible.

It is to be recalled that the parameters indicative of the nitridation tendency of the bath are essentially the temperature of the latter, as well as the state of progress of the refining reactions in time and, more practically, the state of progress of the decarbonization reaction.

It is clearly understood that these parameters are determined empirically according to the configuration and dimensions of the refining installations and it is appropriate to take into account specific factors, like the flow of oxygen blown at the top and the characteristics of the jet or jets emanating from the blast nozzle.

In one preferred working variant of the crucible according to the invention, the injectors are not distributed circularly, but are located in places such that, on rotations of the crucible, they are no longer in contact with the molten metal bath.

The value of such an arrangement is, notably, to be able to stop the agitating gas blast when it is not necessary or no longer necessary, without thereby risking return infiltrations of molten metal into the injectors. The advantage can be easily understood when the injectors are tuyeres, but the benefit obtained is not negligible either in the case of air-permeable refractory elements, at least for some of them, the performance of which depends on the maintenance of a light but permanently necessary flow of gas, even outside of agitating periods, in order to establish in the elements a pressure counterbalancing ferrostatic pressure.

In one embodiment, the injectors are symmetrically located on both sides of the plane of rotation perpendicular to the axis of rotation (axis of the journals equipping the crucible), the crucible being assumed in turn in vertical position.

This arrangement is valid for the principal injectors situated on the periphery, but also, if necessary, for the secondary injectors provided in mid-position between the center and the edge of the bottom. However, if the blast zones are to be distributed better at the bottom of the crucible, those middle injectors will be placed in immediate proximity to the plane of rotation, on both sides and in a direction parallel or roughly parallel to the axis of rotation and, in any event, far enough from the center zone subjected to the influence of the oxygen jets blown at the top, as well as from the side wall, in order to be no longer in contact with the bath, once the crucible is rotated.

The invention will be better understood and other aspects and advantages will appear more clearly in the light of the specification which follows, given with reference to the single plate of attached drawings.

DETAILED DESCRIPTION OF THE INVENTION

Figure 1:
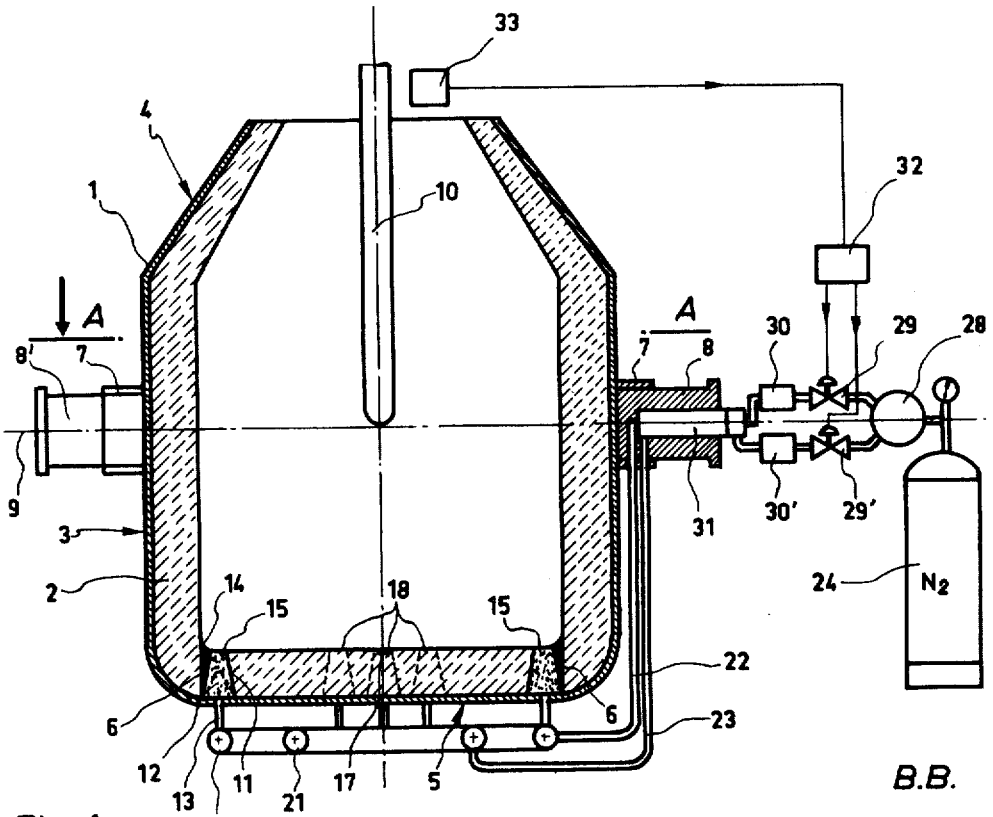
FIG. 1 is a schematic view in vertical section of a crucible according to the invention, along line BB of FIG. 2.

On the figures, the same elements are designated by identical references.

The crucible represented consists mainly of a metal shell of axial symmetry with a thick refractory lining 2. The unit thus formed is composed of a cylindrical part 3 forming the side wall of the crucible and extended at its upper end by a truncted cone-shaped part, or lip 4, and closed opposite its lower part by a fixed bottom 5 by means of a refractory lining ring joint represented by 6.

That cylindrical part presents, almost at midheight of the unit, a conventional reinforcing belt 7 provided with two diametrically opposite journals 8 and 8' assuring the support of the crucible and enabling it to rotate on the axis of rotation symbolized by 9. Furthermore, a vertical nozzle 10 for oxygen blast at the top enters the crucible axially, passing through the lip opening.

As can be seen, bottom 5 of the crucible is equipped with agitating gas injectors 15 and 18 which, in this case, are air-permeable refractory elements incorporated in the refractory brick of the bottom.

It is to be noted that these elements, which do not form part of the specific object of the invention, usually consist of a metal container 11, inside which is placed an air-permeable refractory mass 12, designed so that it can be crossed by a gas under pressure. The gas arrives through an intake pipe 13 provided at the base of the element and enters the bath by the opposite face 14, intended to be brought in contact with the latter.

It is to be further pointed out that, for reasons of obvious convenience, these elements are substituted for common bricks forming the bottom and, in that connection, advantageously have an identical shape and a size that is identical or just slightly smaller than the bricks they replace.

According to one characteristic of the invention, the air-permeable refractory elements are differentiated into two categories identifiable by their geometric location on bottom 5:

a first category consisting of elements 15, separated into two equivalent groups, diametrically opposite and arranged on the periphery of bottom 5, to immediate proximity to side wall 3, along an imaginary circle 16 centered on the middle of the bottom, indicated by 17 on the figures;

a second category consisting of elements 18, also separated into two equivalent groups, diametrically opposite and placed in intermediate position between peripheral elements 15 and center 17, along an imaginary circle 19 concentric to the first one mentioned.

Before continuing, it is important to point out that, in accordance with the main object of the invention, only peripheral elements 15 are indispensable, elements 18 being provided secondarily only as additional elements, giving the process greater flexibility as to the range of total flows of agitating gas that can be injected and as to a possible modulation of the flows according to different zones of injection on bottom 5.

In that connection, it can be seen that two concentric circular feeders 20 and 21 are provided under the bottom a short distance away, supplying elements 15 and elements 18 respectively with agitating gas through suitably arranged pipes 13.

Those feeders are in turn supplied with gas through main pipes 22 and 23, which rise along the cylindrical part and cross journal 8 bored for that purpose, in order to join a pressurized gas source symbolized by 24. The latter is equipped with accessories for separately regulating the gas flows in elements 15 and 16, which will be described in greater detail below.

Figure 2:
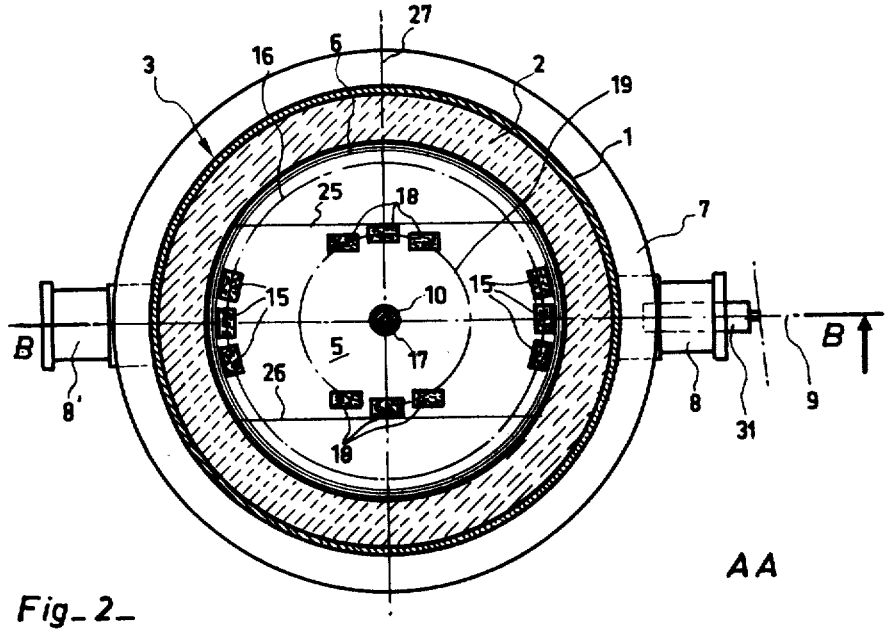
FIG. 2 is a view in horizontal section along line AA of the FIG. 1 and showing the bottom of the crucible.

As can be clearly seen on FIG. 2, peripheral elements 15 are not regularly distributed along circumference 16, but are concentrated opposite axis 9 of the journals.

Such an arrangement is a result of the following considerations:

Two straight lines have been traced at 25 and 26, perpendicular to the plane of rotation symbolized by 27 and corresponding concretely to the intersection of the surface of the bath with bottom 5 of the crucible, when the latter is in rotated position, on one side for deslagging or on the other for pouring of the metal.

These lines which, on the conventional crucibles with blast at the top, are at equal distance from center 17, then define between them a region of the bottom which is no longer in contact with the molten bath when the crucible is in either of its rotation positions.

Hence, it can be understood that if, according to one preferred embodiment of the invention, it should be desired to remove the elements 15 in contact with the bath on crucible emptying operations, it is necessary to locate them on the portions of circle 16 delimited by lines 25 and 26.

It is to be clearly understood that the positions of these lines cannot be determined in advance once and for all, but can vary empirically from one installation to another, depending, notably, on the size of the crucible, the shape of its lip or its degree of filling.

The foregoing indications are also applicable to secondary elements 18. However, considering that the latter do not necessarily have to be placed very far apart from center 17, they may advantageously be arranged along a circle lying entirely between lines 24 and 25, that is, as shown on FIG. 2, along a circle such as 19, the diameter of which is slightly less than the width of the bottom band defined by those two lines.

However, it is often sufficient, taking agitating gas flow requirements into account, to provide secondary elements 18 only on a portion of circle 19.

In that case, it is preferable to arrange them as far as possible from elements 15 so as to distribute to best advantage the blast zone on bottom 5.

Such an arrangement is well represented on FIG. 2, where it can be seen that elements 18 have been placed in proximity to plane of rotation 27, in directions roughly perpendicular to those of primary elements 15.

Indications are now going to be given of the tests using the invention on an industrial scale, referring to the table of values below.

| | N (ppm) |
|---|---|
| Standard L.D. (LDAC, OLP) | 20 |
| LBE according to prior practice | 25-30 |
| LBE according to invention: | |
| - with single peripheral blast ring | 20 |
| - with sequential peripheral blast and middle blast | 20 |

These tests were conducted on a standard crucible with oxygen blast at the top according to the traditional method of the "L.D." process and having a capacity of 310 tons.

In normal operation (without bottom blast), the metal, after refining and before pouring, quite regularly has a nitrogen content of very close to 20 ppm (parts per million)—1st line of table.

The bottom of the crucible was initially equipped with twelve air-permeable refractory elements arranged according to the prior method, that is, regularly distributed along a circle almost midway between the center of the bottom and the refractory side wall.

The results obtained after 250 charges show an average nitrogen content in the bath of 25 to 30 ppm (line 2 of the table). Those charges involved grades of steel, the carbon levels of which were in a range of 25 to 105 thousandths of a percent. The maximum dispersions of the nitrogen content were observed for grades ranging between 70 and 100 thousandths of a percent carbon and rose to nearly 35 ppm over the value indicated above. Under these conditions, a not negligible number of pourings had to be rejected due to excessive nitridation. Consequently, the twelve air-permeable refractory elements were mounted in the bottom according to a geometry conforming to the essential characteristic of the invention, that is, along a circular ring, in immediate proximity to the refractory side wall. Everything else being equal and for the same operating conditions as previously, the tests, which involved a much smaller number of charges, were, nevertheless, sufficient to obtain significant statistical results. These results showed that nitridation of the bath was kept constant at values of 20 ppm (line 3 of the table) with a reduced dispersion having entailed no rejection.

One encounters there results practically identical to those obtained without agitating gas blast (1st line of table) and it can then be concluded that the invention renders the metal bath almost "transparent" to the agitating nitrogen.

A third series of tests was conducted, following the method of introducing twelve air-permeable elements, as previously described with reference to the figures, that is, according to an arrangement in two categories 15 and 18.

Following an injection of gas according to an operational plan to be specified below, the results showed a nitridation tendency which was limited to approximately 20 ppm (line 4 of the table), in spite of the activation of air-permeable elements 18 in an intermediate arrangement.

In fact, those results could be obtained thanks to a blast plan which consisted essentially of a modulation of flows blown through the elements of both categories, depending on the state of progress of the refining operation. More precisely, only the peripheral elements were activated in the course of the terminal phase of decarbonization of the bath, the other elements having been also activated only after completion of that phase.

Of course, such an operating plan could be used thanks to a system making possible separate supplies of each category of elements.

A system of this type is schematically represented on the right side of FIG. 1. It includes, between the single pressurized nitrogen source 24 and the two main feed pipes 22 and 23 an electropneumatic unit embracing, from the outlet of the source, a general volumetric indicator 28 operating in two parallel circuits, each equipped with an electrovalve 29 (29') with "on-off" control, followed by a sub-assembly 30 (30') grouping standard components for regulating the flow from a fixed or variable reference value.

It is all connected to pipes 22 and 23 by a tight circular coupling 31 with two concentric passages at journal 8, enabling the feed system to be locked in spite of the movements of the crucible on its axis of rotation.

As far as the method of operation is concerned, it is useful to point out that the expert, by mere virtue of the experience he has acquired in the practice of refining with oxygen blown at the top, knows at all times the state of progress of the metallurgical reactions inside the crucible and can, consequently, act manually on controls 29 and 29' with full knowledge of the facts.

Nonetheless, the invention lends itself perfectly to integration in an automatic control system assisted by a computer, such as symbolized by 32 and controlling electrovalves 29 and 29' from a detector 33 measuring the parameters representing the state of progress of the refining operation and, therefore, the nitridation tendency of the bath, like, for example, the temperature of the reaction gases and their composition, notably, in carbon monoxide.

It goes without saying that the invention should not be limited to the examples described with reference to the figures, but extends to any variants or equivalents, to the extent that the characteristics contained in the enclosed claims are reproduced.

In particular, the invention applies not only to nitrogen, but to any other agitating gas capable of being dissolved in the molten metal contained in the crucible and the final quality of which is not unaffected by its concentration of that gas.

Thus, the invention, in its embodiment with two geometrically differentiated categories of injectors, appears to be not only a method of reduction of the nitridation of a steel bath agitated with nitrogen, but also, much more generally, a method of control of rates of dissolution of an agitating gas in a molten bath, whatever the respective natures of that gas and of that bath.

In that respect, the invention is not limited to just two categories of injectors, but extends to a greater number, knowing that the dissolution tendency increases when activating the injectors close to the center of the bottom and decreases when approaching the refractory side wall.

In other respects, those injectors do not necessarily have to be preformed functional units (tuyeres or air-permeable refractory elements), but can very well present no special features as such and be introduced in the actual course of construction of the bottom of the crucible, e.g., by means of refractory bricks specially shaped to fit, once juxtaposed, spaces reserved for gas blowing, as described, notably, in American Pat. No. 2,456,798 (Slick).

It is likewise clear that there does not necessarily have to be just one source of agitating gas under pressure, but rather the source can be increased tenfold at will and, notably, as many times as the number of categories of injectors.

It will be understood that each of the elements described above, or two or more together, may also find a useful application in other types of processes of refining of a metal bath with oxygen blast differing from the types described above.

While the invention has been illustrated and described as embodied in a process of refining of a metal bath with oxygen blast it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process of refining a metal bath in a crucible, which is adapted to rotate between two tilted positions relative to a plane of rotation and includes a peripheral wall, a top and a bottom, by injecting an oxygen blast into the crucible at the top thereof, comprising injecting an agitating gas into the crucible at the periphery of the bottom thereof and in immediate proximity to said peripheral wall, the agitating gas being injected at the area of said bottom lying between two straight substantially parallel lines each representing the intersection of said bottom with the surface of the bath when the crucible is in one of its tilted positions.

2. A refining crucible with a metal bath, adapted to rotate between two tilted positions relative to a plane of rotation and comprising a top portion for receiving oxygen to be blown into the crucible; a peripheral wall having a refractory lining; a bottom wall having a periphery and a center; and a plurality of injectors for injecting an agitating gas into the crucible, said injectors being located at the periphery of said bottom and in immediate proximity to said refractory lining and at the area of said bottom lying between two substantially parallel lines each representing the intersection of said bottom with the surface of the bath when the crucible is in one of its tilted positions.

3. The process of claim 1, wherein the agitating gas is injected in said region and in the immediate proximity to said plane of rotation of the crucible.

4. The process of claim 3, wherein the agitating gas is also injected at a middle part of the bottom, said middle part being located between the center of the bottom and the periphery thereof.

5. The process of claim 4, wherein the parameters indicative of the dissolution tendency of the agitating gas injected into the crucible are determined in the course of refining and according to the response obtained by modifying the geometric conditions of the injection of the agitating gas at the bottom of the crucible in the area between the periphery of said bottom and the center thereof.

6. The process of claim 5, wherein the agitating gas is nitrogen, the parameters indicative of the nitridation tendency of the bath being determined in the course of refining by a measurement of the state of progress of decarbonization of the bath.

7. The crucible of claim 2, wherein said crucible has a substantially cylindrical configuration, said injectors being located along an imaginary peripheral ring situated in the immediate proximity of said refractory lining.

8. The crucible of claim 7, further including injectors located along an imaginary ring located between said center of the bottom wall and said peripheral ring.

9. The crucible of claim 8, further including means for feeding said injectors, said feeding means including a first feeder connected to the injectors located along the peripheral ring and a second feeder connected to the injectors located between said center and said peripheral ring.

10. The crucible of claim 8, said injectors located along said peripheral ring being concentrated in the proximity to an axis perpendicular to said plane of rotation, said injectors located along said imaginary ring between said center and said peripheral ring being concentrated in the immediate proximity to said plane of rotation and in a direction approximately perpendicular to that of said injectors located along said peripheral ring.

* * * * *